United States Patent [19]

Vodicka et al.

[11] 4,210,841

[45] Jul. 1, 1980

[54] ALL PLASTIC HEADLAMP

[75] Inventors: Vincent Vodicka, South Euclid, Ohio; Fred F. Holub, Schenectady, N.Y.

[73] Assignee: General Electric Company, Schenectady, N.Y.

[21] Appl. No.: 896,707

[22] Filed: Apr. 17, 1978

[51] Int. Cl.[2] ..... H01J 61/30

[52] U.S. Cl. ..... 313/221; 313/113; 313/220

[58] Field of Search ..... 313/221, 220, 113; 362/267

[56] References Cited

U.S. PATENT DOCUMENTS

| | | | |
|---|---|---|---|
| Re. 25,017 | 8/1961 | Cooper | 313/221 |
| 2,592,102 | 4/1952 | Alexander . | |
| 3,343,021 | 9/1967 | Burnett et al. . | |
| 3,445,662 | 5/1969 | Langley . | |
| 4,011,642 | 3/1977 | Meinecke et al. . | |
| 4,019,045 | 4/1977 | Bassett | 362/267 |

*Primary Examiner*—Siegfried H. Grimm
*Assistant Examiner*—Darwin R. Hostetter
*Attorney, Agent, or Firm*—Lawrence R. Kempton

[57] ABSTRACT

A practical all plastic headlamp is disclosed comprising, for the lens and reflector, an engineering plastic having a heat distortion temperature in excess of 130° C.

10 Claims, 1 Drawing Figure

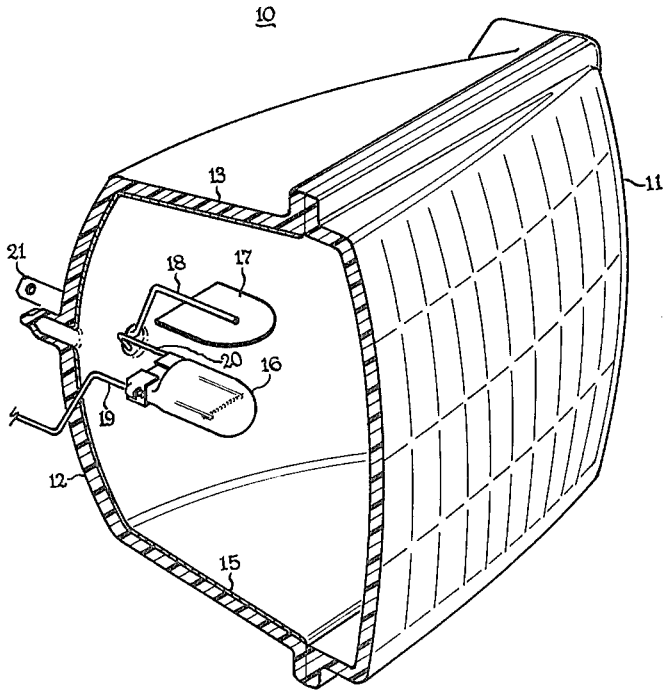
10
11
13
21
18
17
20
16
19
12
15

ALL PLASTIC HEADLAMP

This invention relates to PAR (parabolic, aluminized reflector) lamps and, in particular to an all plastic headlamp having a sealed inner bulb as the light source.

In this era of sealed beam lamps it is sometimes difficult to remember that non-sealed beam headlamps, ie. headlamps having an inner lamp, date back almost to the invention of the automobile. However, the disadvantages of such a structure remain, eg. deteriorating performance or failure caused by dirt, water, corrosion, and condensation. The all-glass, sealed beam PAR lamp alleviates these problems but is no panacea.

Because an all-glass design is used in current sealed beam headlamps, the lamps are heavier than they might be otherwise. Also, there are limits on the mold designs for glass that do not exist for molds for plastic. Further, considering the equipment investment which must be made by a manufacturer, plastic is more easily handled and does not wear molds out as quickly as glass.

Desiring an alternative to an all-glass construction is not the same as finding a practical design. For example, in U.S. Pat. No. Re. 25,107 an all plastic sealed beam lamp is described. While a lamp built as described therein may be made to operate, the result is not necessarily a commercially viable headlamp. For example, the exposed filament cannot survive the three hundred or so hours lamp operating life required of automotive headlamps. Also, so far as is known, no plastic is impervious to water vapor or other gases over the life of the lamp. (In all glass PAR lamps, the fusion of the lens to the reflector renders the lamp impervious to water vapor or other gases.) Further, in use, the "hot spot" on a headlamp, herein defined as the region in the reflector above the filament, may easily exceed the 80° C. discussed in the patent. Similarly, particularly if the lamp is dirty, a second "hot spot", herein defined as a region on the lens approximately one-fourth the distance down from the top of the lamp, may also exceed 80° C., depending upon ambient conditions.

In view of the foregoing, it is therefore an object of the present invention to provide a practical plastic PAR lamp.

Another object of the present invention is to provide a plastic PAR lamp suitable for use in vehicle lighting.

A further object of the present invention is to provide an all-plastic lamp capable of dissipating wattages comparable to all-glass PAR lamps.

Another object of the present invention is to provide a plastic lamp in which the atmosphere within the plastic envelope need not be devoid of water vapor or other gases.

The foregoing objects are achieved in the present invention wherein the PAR lamp comprises a high (greater than 130° Celsius) heat distortion temperature plastic, such as polycarbonate copolymers or polysulfone, having a loading of from 4.5 to 7.8% which may be alternatively expressed as 0.045–0.078 watts/cc. As used herein, "loading" is defined as the watts dissipated in a given volume and has the units watts per cubic centimeter (W/cc.).

A more complete understanding of the present invention can be obtained by considering the following detailed description in conjunction with the accompanying drawing, in which:

The FIGURE illustrates a preferred embodiment of a PAR lamp in accordance with the present invention.

The FIGURE illustrates a lamp 10 in accordance with the present invention, in this particular example having the configuration of a rectangular headlamp. Specifically, lamp 10 comprises a lens 11 suitably attached to a reflector 12 having a specular coating 15 on the interior thereof. Sealed within lamp 10 is an inner bulb 16 which preferably comprises a sealed halogen cycle lamp suitably attached to leads 19 and 20 which exit the rear or bottom of reflector 12 and are each connected to a suitable terminal, such as terminal 21. Positioned above inner bulb 16 is a heat shield, preferably comprising a metal disc 17 attached to a conductive lead 18, which serves to interfere with the convection heating of the hot spot on lamp 10, which forms directly above inner bulb 16 in the flat portion of reflector 12. The convection currents in the atmosphere within lamp 10 are spread by shield 17, which causes the atmosphere to mix thereby diffusing the heat from inner bulb 16 into a greater volume of the atmosphere within lamp 10. To some extent, shield 17 acts as a sink by absorbing heat and redistributing it over a larger area, thus reducing the temperature of the hot spot.

It has been found that plastic lamps can be made from plastics having a heat distortion temperature in excess of 130° C. and a thickness of 50–120 mils if the volume of the lamp and the wattage dissipated by the filament are such that no more than $7.8\times10^{-2}$ watts per cc are dissipated within the lamp. For example, lamps having a life in excess of approximately 300 hours have been made comprising an inner bulb dissipating approximately 50–65 watts in lamps having an interior volume of 830–1100 cc's. These lamps are dimensionally the same as the inner lamps in a four-lamp rectangular headlamp lighting system. In operation, the lamp breathes, ie. the plastic is not impervious to the ambient atmosphere. As the lamp is turned on and off, the atmosphere within the lamp heats and cools, eventually causing some of the ambient atmosphere to permeate the plastic. Since an inner bulb is used, the filament is protected from the change in the atmosphere within lamp 10 and, in turn, the atmosphere within lamp 10 is protected from the extremely high temperature of the filament such that chemical reactions are not caused thereby. Since inner bulb 16 is permanently attached within the reflector, the permeation of the ambient atmosphere is sufficiently slow that sufficient contaminants cannot accumulate within the lamp atmosphere prior to the expiration of the life of bulb 16 to cause deterioration of the lamp.

Suitable plastics for use in the present invention include, by way of example only, polycarbonate copolymers, such as sold under the trade name "Lexan" by General Electric Company, and polysulfone. Further, depending upon the plastic chosen, an abrasion resistant coating comprising for example acrylate resins, melamine resins, or siloxane resins, may be applied to the outer surface of lens 11. While polycarbonate copolymers and polysulfones are generally transparent, opaque polymers having a heat distortion temperature in excess of 130° C., may be utilized for the reflector, such as filled phenolic resins, polyimide resins, and polyphenylene oxide type resins.

There is thus provided by the present invention a practical all-plastic PAR lamp suitable for use in vehicle lighting systems. Further, the present invention enables one to consider alternative designs in plastic which were heretofore impractical in glass, for example, overall lamp shapes and lens configurations.

Having thus described the invention it will be apparent to those of skill in the art that various modifications can be made within the spirit and scope of the present invention. For example, heat reflecting/light transmitting coatings, known in the art, may be applied within the lamp to assist the plastic in tolerating the heat from the filament.

What we claim as new and desire to secure by United States Letters Patent is:

1. In a sealed, long life headlamp having a transparent plastic lens, a plastic reflector having a specular coating thereon, and at least one filament, the improvement comprising:

a sealed inner bulb enclosing said at least one filament with lead wires therefor, sealed through said reflector, and with said filament operating at a sufficient wattage and lumen output for the principal forward lighting source for a motor vehicle;

said lens and reflector characterized by a heat distortion temperature in excess of 130° Celsius; and said lens and reflector being sealed together to define an enclosed volume and said filament having a wattage such that the loading of said headlamp in watts per cc. is from 0.045–0.078 inclusive.

2. The headlamp as set forth in claim 1 wherein said lens and reflector comprise a polycarbonate copolymer.

3. The headlamp as set forth in claim 1 wherein said lens and reflector comprise polysulfone.

4. The headlamp as set forth in claim 1 wherein said inner bulb contains a fill gas comprising a halide.

5. The headlamp as set forth in claim 4 wherein said filament has a design life in excess of 250 hours.

6. The headlamp as set forth in claim 5 wherein said filament has a design wattage of from 50 to 60 watts inclusive.

7. The headlamp as set forth in claim 6 and further comprising heat shield means interposed between said filament and a hot spot of the lamp.

8. The headlamp as set forth in claim 7 wherein said heat shield means comprises a metal disc positioned above the filament.

9. The headlamp as set forth in claim 1, wherein a radiation, heat and abrasion resistant transparent coating is applied to at least a portion of said headlamp.

10. In a sealed, long life headlamp having a transparent plastic lens, a plastic reflector having a specular coating thereon, and at least one filament, the improvement comprising:

a sealed inner bulb enclosing said at least one filament and having a halogen gas therein with lead wires therefor, sealed through said reflector, and with said filament operating at a sufficient wattage and lumen output for the principal forward lighting source for a motor vehicle;

said lens and reflector characterized by a heat distortion temperature in excess of 130° Celsius; and said lens and reflector being sealed together to define an enclosed volume and said filament having a wattage such that the loading of said headlamp in watts per cc. is from 0.045–0.078 inclusive.

* * * * *